US006439025B1

(12) United States Patent
Peters

(10) Patent No.: US 6,439,025 B1
(45) Date of Patent: Aug. 27, 2002

(54) SHEET METAL DENT REMOVING DEVICE

(76) Inventor: Clarence Peters, 3125 Park Ave. Apt #29B, Bronx, NY (US) 10451

( * ) Notice: Subject to any disclaimer, the term of this patent is extended or adjusted under 35 U.S.C. 154(b) by 0 days.

(21) Appl. No.: 09/747,891

(22) Filed: Dec. 26, 2000

(51) Int. Cl.[7] ..... B21J 13/02

(52) U.S. Cl. ..... 72/479; 72/466.8; 72/481.3; 72/481.8; 72/705

(58) Field of Search ..... 72/457, 465.1, 72/466.8, 479, 481.1, 481.3, 481.4, 481.5, 481.8, 705

(56) References Cited

U.S. PATENT DOCUMENTS

| | | | | | |
|---|---|---|---|---|---|
| 2,941,429 | A | * | 6/1960 | Mason | 72/705 |
| 3,570,289 | A | | 3/1971 | Smyers | |
| 3,635,072 | A | * | 1/1972 | Steinman, Jr. | 72/705 |
| 3,922,902 | A | * | 12/1975 | Jarman | 72/705 |
| 4,072,042 | A | | 2/1978 | Servin et al. | |
| 4,122,699 | A | | 10/1978 | Logsdon | |
| 4,586,230 | A | | 5/1986 | Harydzak et al. | |
| 4,653,167 | A | * | 3/1987 | Mullins | 72/705 |
| 5,329,802 | A | | 7/1994 | Nunez | |
| 5,408,861 | A | * | 4/1995 | McCain et al. | 72/705 |
| D396,620 | S | | 8/1998 | Sung | |

* cited by examiner

*Primary Examiner*—Ed Tolan

(57) ABSTRACT

A sheet metal dent removing device for combining a drill and a slide hammer used for removing dents. The sheet metal dent removing device includes an electric drill. The electric drill includes a body having a distal end, a proximal end and a peripheral wall extending between. A handle extends from the peripheral wall and is positioned generally adjacent to the proximal end. An actuating means turns the electric drill on and off. A shaft is elongate and has a first end and a second end. The first end of the shaft extends into the distal end of the body. The electric drill is adapted to rotate the shaft. A drill bit has a first end and a second end. The first end tapers to a point and the length of the drill bit is threaded. A coupling means removably couples the drill bit to the second end of the shaft. A slide hammer comprises a tubular member having an aperture extending therethrough. The shaft extends through the tubular member such that the tubular member is movably positioned on the shaft between the electric drill and the first end of the shaft.

4 Claims, 3 Drawing Sheets

SHEET METAL DENT REMOVING DEVICE

BACKGROUND OF THE INVENTION

1. Field of the Invention

The present invention relates to dent removing devices and more particularly pertains to a new sheet metal dent removing device for combining a drill and a slide hammer used for removing dents.

2. Description of the Prior Art

The use of dent removing devices is known in the prior art. More specifically, dent removing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,329,802; U.S. Pat. No. 4,586,230; U.S. Pat. No. 4,122,699; U.S. Pat. No. 3,570,289; U.S. Pat. No. 4,072,042; and Des. U.S. Pat. No. 396,620.

While these devices fulfill their respective, particular objectives and requirements, the aforementioned patents do not disclose a new sheet metal dent removing device. The inventive device includes an electric drill. The electric drill includes a body having a distal end, a proximal end and a peripheral wall extending between. A handle extends from the peripheral wall and is positioned generally adjacent to the proximal end. An actuating means turns the electric drill on and off. A shaft is elongate and has a first end and a second end. The first end of the shaft extends into the distal end of the body. The electric drill is adapted to rotate the shaft. A drill bit has a first end and a second end. The first end tapers to a point and the length of the drill bit is threaded. A coupling means removably couples the drill bit to the second end of the shaft. A slide hammer comprises a tubular member having an aperture extending therethrough. The shaft extends through the tubular member such that the tubular member is movably positioned on the shaft between the electric drill and the first end of the shaft.

In these respects, the sheet metal dent removing device according to the present invention substantially departs from the conventional concepts and designs of the prior art, and in so doing provides an apparatus primarily developed for the purpose of combining a drill and a slide hammer used for removing dents.

SUMMARY OF THE INVENTION

In view of the foregoing disadvantages inherent in the known types of dent removing devices now present in the prior art, the present invention provides a new sheet metal dent removing device construction wherein the same can be utilized for combining a drill and a slide hammer used for removing dents.

The general purpose of the present invention, which will be described subsequently in greater detail, is to provide a new sheet metal dent removing device apparatus and method which has many of the advantages of the dent removing devices mentioned heretofore and many novel features that result in a new sheet metal dent removing device which is not anticipated, rendered obvious, suggested, or even implied by any of the prior art dent removing devices, either alone or in any combination thereof.

To attain this, the present invention generally comprises an electric drill. The electric drill includes a body having a distal end, a proximal end and a peripheral wall extending between. A handle extends from the peripheral wall and is positioned generally adjacent to the proximal end. An actuating means turns the electric drill on and off. A shaft is elongate and has a first end and a second end. The first end of the shaft extends into the distal end of the body. The electric drill is adapted to rotate the shaft. A drill bit has a first end and a second end. The first end tapers to a point and the length of the drill bit is threaded. A coupling means removably couples the drill bit to the second end of the shaft. A slide hammer comprises a tubular member having an aperture extending therethrough. The shaft extends through the tubular member such that the tubular member is movably positioned on the shaft between the electric drill and the first end of the shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sheet metal dent removing device apparatus and method which has many of the advantages of the dent removing devices mentioned heretofore and many novel features that result in a new sheet metal dent removing device which is not anticipated, rendered obvious, suggested, or even implied by any of the prior art dent removing devices, either alone or in any combination thereof.

It is another object of the present invention to provide a new sheet metal dent removing device which may be easily and efficiently manufactured and marketed.

It is a further object of the present invention to provide a new sheet metal dent removing device which is of a durable and reliable construction.

An even further object of the present invention is to provide a new sheet metal dent removing device which is susceptible of a low cost of manufacture with regard to both materials and labor, and which accordingly is then susceptible of low prices of sale to the consuming public, thereby making such sheet metal dent removing device economically available to the buying public.

Still yet another object of the present invention is to provide a new sheet metal dent removing device which provides in the apparatuses and methods of the prior art some of the advantages thereof, while simultaneously overcoming some of the disadvantages normally associated therewith.

Still another object of the present invention is to provide a new sheet metal dent removing device for combining a drill and a slide hammer used for removing dents.

Yet another object of the present invention is to provide a new sheet metal dent removing device which includes an electric drill. The electric drill includes a body having a distal end, a proximal end and a peripheral wall extending between. A handle extends from the peripheral wall and is positioned generally adjacent to the proximal end. An actuating means turns the electric drill on and off. A shaft is elongate and has a first end and a second end. The first end of the shaft extends into the distal end of the body. The electric drill is adapted to rotate the shaft. A drill bit has a first end and a second end. The first end tapers to a point and the length of the drill bit is threaded. A coupling means removably couples the drill bit to the second end of the shaft. A slide hammer comprises a tubular member having an aperture extending therethrough. The shaft extends through the tubular member such that the tubular member is movably positioned on the shaft between the electric drill and the first end of the shaft.

Still yet another object of the present invention is to provide a new sheet metal dent removing device that combines two tools. Generally, a drill is first used to make a hole in the sheet metal where a dent needs to be pulled out. Once the hole is drilled into the sheet metal, a slide hammer, having a threaded end, is placed into the hole. The slide hammer is then used to pull or pop the dent out by sliding the slide hammer back. The device combines the tools into one tool.

Even still another object of the present invention is to provide a new sheet metal dent removing device that has a drill bit having a two portions having different diameters for re-drilling a hole after it has been enlarged due to use of the slide hammer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
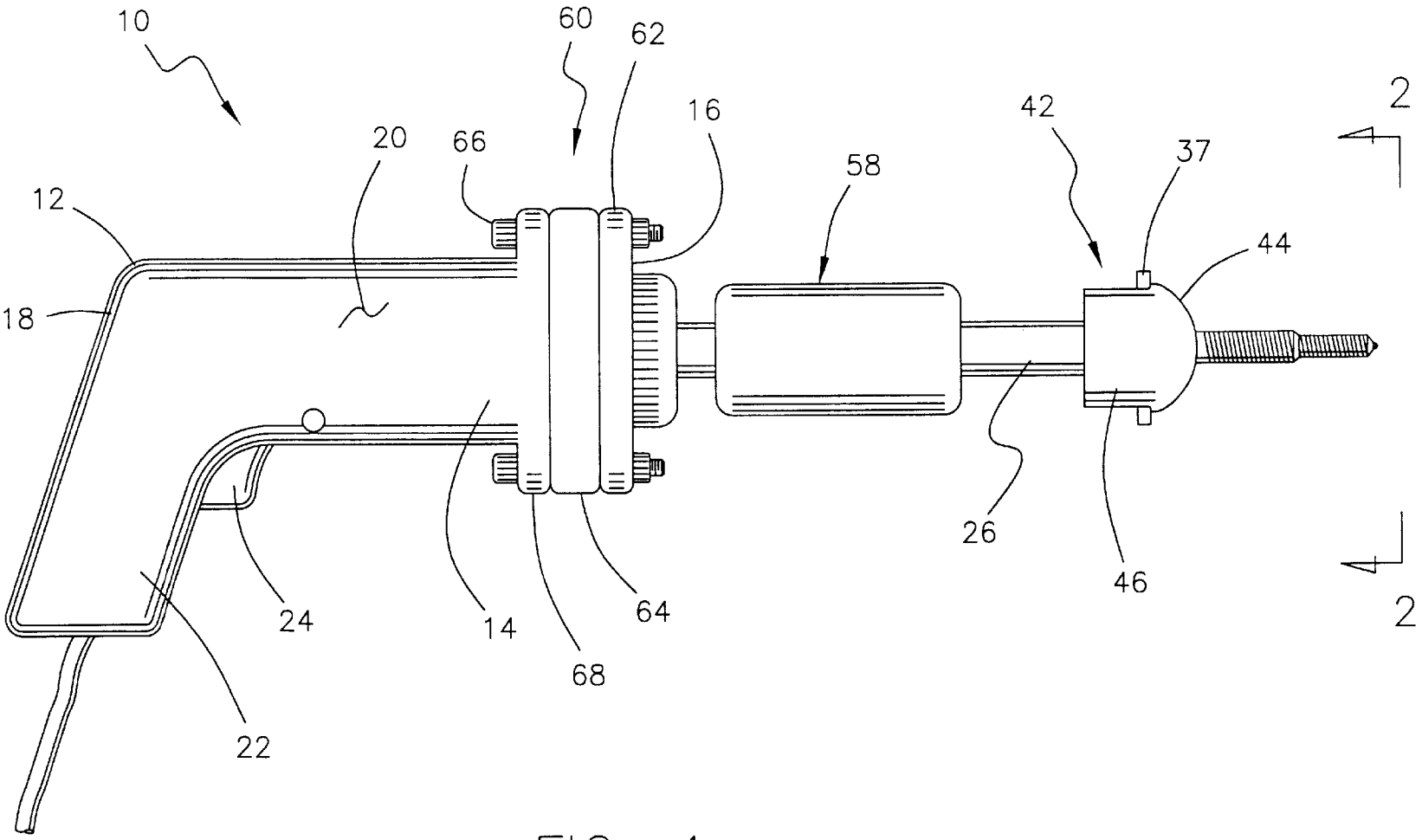
FIG. 1 is a schematic side view of a new sheet metal dent removing device according to the present invention.
Figure 2:
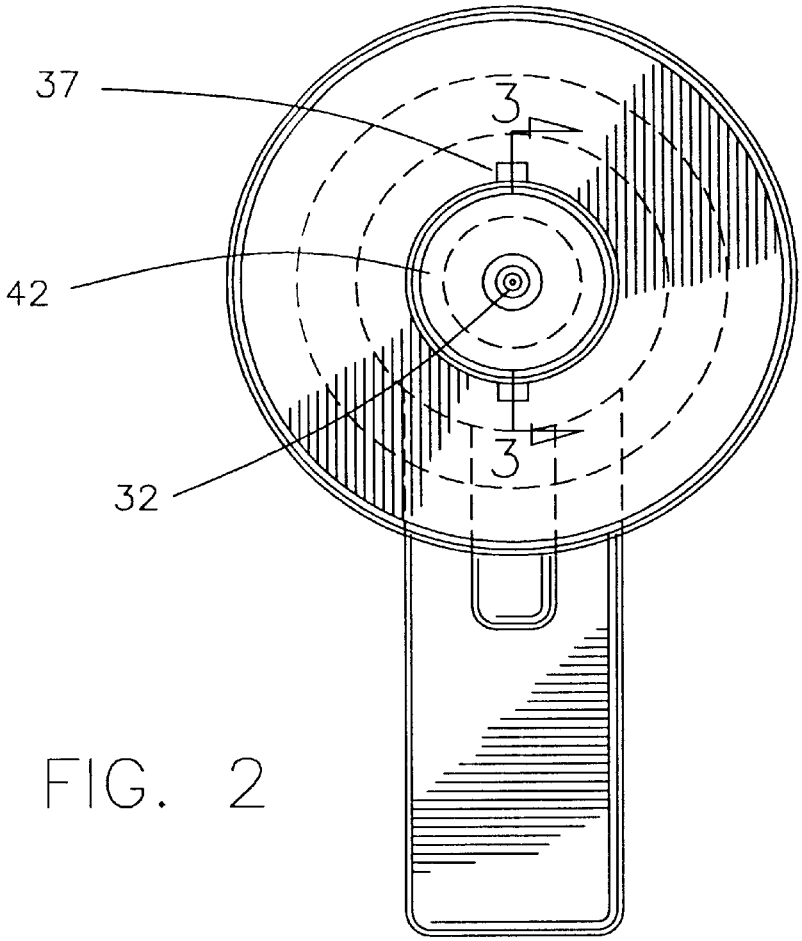
FIG. 2 is a schematic end view of the present invention.
Figure 3:
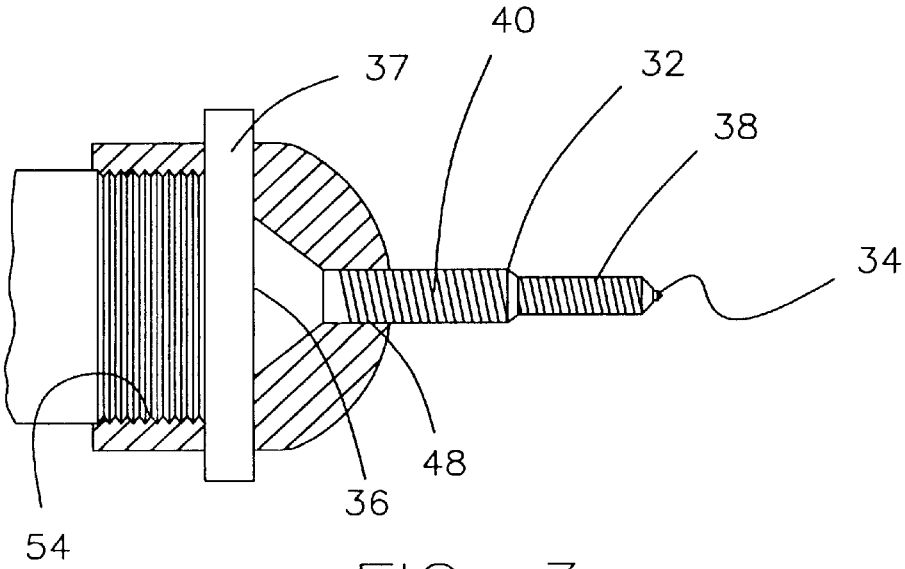
FIG. 3 is a schematic cross-sectional view taken along line 3—3 of the present invention.
Figure 4:
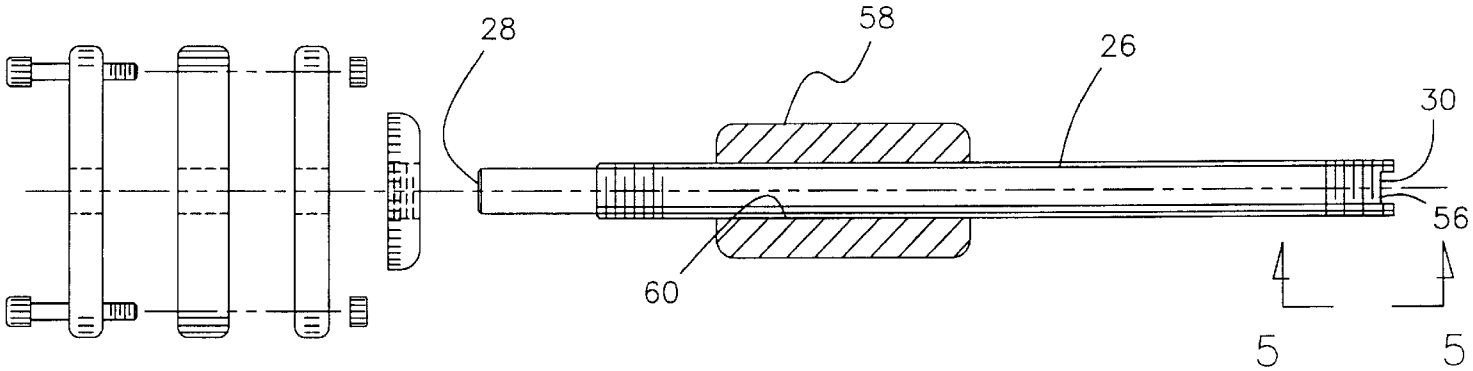
FIG. 4 is a schematic side view of the present invention.
Figure 5:
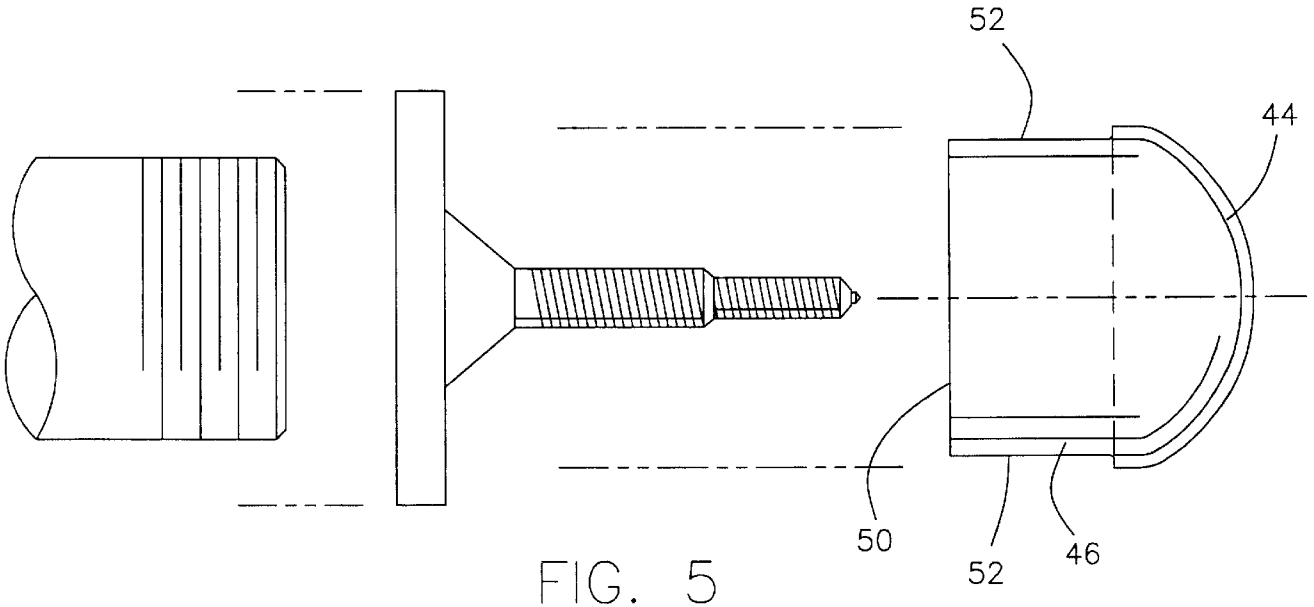
FIG. 5 is a schematic side view of the drill bit and coupling means of the present invention.

With reference now to the drawings, and in particular to FIGS. 1 through 5 thereof, a new sheet metal dent removing device embodying the principles and concepts of the present invention and generally designated by the reference numeral 10 will be described.

As best illustrated in FIGS. 1 through 5, the sheet metal dent removing device 10 generally includes an electric drill 12. The electric drill 12 includes a body 14 having a distal end 16, a proximal end 18 and a peripheral wall 20 extending between. A handle 22 extends from the peripheral wall 20 and is positioned generally adjacent to the proximal end 18. An actuating means 24 turns the electric drill 12 on and off. The electric drill 12 is generally a conventional electric drill.

A shaft 26 is elongate and has a first end 28 and a second end 30. The first end 28 of the shaft 26 extends into the distal end 14 of the body 22. The electric drill 12 is adapted to rotate the shaft 26.

A drill bit 32 has a first end 34 and a second end 36. The first end 34 tapers to a point. The drill bit 32 is threaded. Preferably a bar 37 is securely coupled to the second end 36 of the drill bit 32. The bar 37 is orientated generally perpendicular to the drill bit. The drill bit 32 is coupled to a central portion of the bar 37. Ideally, the drill bit 32 has a first portion 38 and a second portion 40. The first portion 38 abuts the first end 34. The second portion 40 has a diameter greater than a diameter of the first portion 38.

A coupling means 42 removably couples the bar 37, or drill bit 32, to the second end 30 of the shaft 26. The coupling means 42 comprises cover portion. The cover portion includes a wall 44. The wall 44 has a peripheral wall 46 integrally coupled thereto and extending away therefrom. The wall 46 has a hole 48 therein for extendably positioning the drill bit 32 through. The peripheral wall 46 has a free end 50. The free end 50 has a pair of slots 52 extending therein. The slots 52 are generally oppositely disposed in the peripheral wall 46. The bar 37 may releasably engage the slots 52 when the drill bit 32 is extended into the hole 48. The peripheral wall 46 has an inner surface adapted for releasably coupling to the shaft 26. The peripheral wall may be threaded 54, as would be the shaft 26 for screwing the two together. Alternatively, the shaft 26 may have a channel 56 for receiving the bar 37 and the peripheral wall 46 would snap onto the shaft 26. The slots 52 and the channel 56 force the drill bit 32 to rotate with the shaft 26.

A slide hammer 58 comprises a tubular member having an aperture 60 extending therethrough. The shaft 26 extends through the tubular member such that the tubular member is movably positioned on the shaft 26 between the electric drill 12 and the second end 30 of the shaft.

Preferably, a distal portion 60 of the device includes a plate 62 removably mounted to the body 14 by a plurality of screws 66. Between the plate 62 and the body 14 is a resiliently flexible panel 64 ideally comprised of an elastomeric material. The strike hammer strikes the plate 62 and the panel 64 helps to protect drill from damage. The screws are ideally extended through a lip 68 so that they allow the plate 62 to move toward the body 14 and compress the panel 64.

In use, the drill bit 32 is used to drill into sheet metal where there is a dent. The slide hammer 58 is then positioned against the coupling means 42. The slide hammer 58 is slit back against the distal end 16 of the electric drill 12 so that the electric drill 12 is pulled back, which in turn pulls the dent outward. Often the action of the slide hammer causes the hole, which was made by the drill bit 32, to increase in size. Conventional tools used for this would require a second hole to be drilled and the process repeated. The second portion of the drill bit is larger so that the user may simply drill into the existing hole so that the threads on the second portion 40 may grip the edge of the hole when using the slide hammer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electric dent removing device for removing dents from metal, said device comprising:

an electric drill, said electric drill including a body having a distal end, a proximal end and a peripheral wall extending between, a handle extending from said peripheral wall and positioned generally adjacent to said proximal end, an actuating means for turning said electric drill on and off;

a shaft, said shaft being elongate and having a first end and a second end, said first end of said shaft extending into said distal end of said body, said electric drill being for rotating said shaft;

a drill bit, said drill bit having a first end and a second end, said first end tapering to a point, said drill bit being threaded;

a coupling means for removably coupling said drill bit to said second end of said shaft;

a slide hammer, said slide hammer comprising a tubular member having an aperture extending therethrough, said shaft extending through said tubular member such that said tubular member is movably positioned on said shaft between said electric drill and said second end of said shaft;

a bar being securely coupled to said second end of said drill bit, said bar being orientated generally perpendicular to said drill bit, said drill bit being coupled to a central portion of said plate; and said coupling means comprising cover portion, said cover portion comprising a wall, said wall having a peripheral wall integrally coupled thereto and extending away therefrom, said wall having a hole therein for extending said drill bit through, said peripheral wall having a free end, said free end having a pair of slots extending therein, said slots being generally oppositely disposed in said peripheral wall, wherein said bar may releasably engage said slots when said drill bit is extended into said hole, said peripheral wall having an inner surface being for releasably coupling to said shaft.

2. The electric dent removing device as in claim 1, further comprising:

said drill bit having a first portion and a second portion, said first portion abutting said first end, said second portion having a diameter greater than a diameter of said first portion.

3. The electric dent removing device as in claim 1, further comprising:

said drill having a distal portion abutting said distal end, said distal portion comprising a plate removably mounted to said body by a plurality of fasteners, a resiliently flexible panel being positioned between said body and said plate.

4. An electric dent removing device for removing dents from metal, said device comprising:

an electric drill, said electric drill including a body having a distal end, a proximal end and a peripheral wall extending between, a handle extending from said peripheral wall and positioned generally adjacent to said proximal end, an actuating means for turning said electric drill on and off;

a shaft, said shaft being elongate and having a first end and a second end, said first end of said shaft extending into said distal end of said body, said electric drill being being for rotating said shaft;

a drill bit, said drill bit having a first end and a second end, said first end tapering to a point, said drill bit being threaded, a bar being securely coupled to said second end of said drill bit, said bar being orientated generally perpendicular to said drill bit, said drill bit being coupled to a central portion of said bar, said drill bit having a first portion and a second portion, said first portion abutting said first end, said second portion having a diameter greater than a diameter of said first portion;

a coupling means for removably coupling said bar to said second end of said shaft, said coupling means comprising cover portion, said cover portion comprising a wall, said wall having a peripheral wall integrally coupled thereto and extending away therefrom, said wall having a hole therein for extendably positioning said drill bit through, said peripheral wall having a free end, said free end having a pair of slots extending therein, said slots being generally oppositely disposed in said peripheral wall, wherein said bar may releasably engage said slots when said drill bit is extended into said hole, said peripheral wall having an inner surface being for releasably coupling to said shaft; and a slide hammer, said slide hammer comprising a tubular member having an aperture extending therethrough, said shaft extending through said tubular member such that said tubular member is movably positioned on said shaft between said electric drill and said second end of said shaft.

* * * * *